US012440726B2

(12) United States Patent
Liu et al.

(10) Patent No.: US 12,440,726 B2
(45) Date of Patent: Oct. 14, 2025

(54) BOTTOM-FREE STATIONARY BIKE

(71) Applicant: Dyaco International Inc., Taipei (TW)

(72) Inventors: Shih-Wei Liu, Taipei (TW); Wei-Hsiang Lin, Changhua County (TW)

(73) Assignee: Dyaco International Inc., Taipei (TW)

( * ) Notice: Subject to any disclaimer, the term of this patent is extended or adjusted under 35 U.S.C. 154(b) by 65 days.

(21) Appl. No.: 18/435,874

(22) Filed: Feb. 7, 2024

(65) Prior Publication Data

US 2025/0235742 A1 Jul. 24, 2025

(30) Foreign Application Priority Data

Jan. 18, 2024 (TW) ..... 113102095

(51) Int. Cl.
*A63B 22/06* (2006.01)
*A63B 21/00* (2006.01)
*A63B 22/00* (2006.01)

(52) U.S. Cl.
CPC ..... *A63B 22/0605* (2013.01); *A63B 21/4034* (2015.10); *A63B 21/4035* (2015.10); *A63B 22/0046* (2013.01); *A63B 2225/09* (2013.01)

(58) Field of Classification Search
CPC ..... A63B 22/0605; A63B 22/0046; A63B 21/4034; A63B 21/4035; A63B 2225/09
See application file for complete search history.

(56) References Cited

U.S. PATENT DOCUMENTS

2015/0087481 A1* 3/2015 Liu ..... A63B 22/0015 482/52
2018/0273136 A1* 9/2018 Voss ..... B62K 25/30
2019/0381351 A1* 12/2019 Irving ..... A63B 21/225
2022/0111246 A1* 4/2022 Ellis ..... A63B 22/205
2023/0134879 A1* 5/2023 Brown ..... A63B 21/00072 482/62
2024/0123279 A1* 4/2024 Ellis ..... A63B 22/001

* cited by examiner

*Primary Examiner* — Christopher E Dunay
(74) *Attorney, Agent, or Firm* — Donald E. Stout; Stout, Uxa & Buyan, LLP

(57) ABSTRACT

A bottom-free stationary bike vehicle includes a first movable structure, a second movable structure, a frame, and a linear mechanism. The first movable structure is turnable with its first end as a fulcrum. The second movable structure is turnable with its first end as a fulcrum. A second end of the first movable structure and a second end of the second movable structure are pivotally connected at a pivot. The frame is connected to the first movable structure. The linear mechanism is connected between the frame and the second movable structure. The length of the linear mechanism can be adjusted to change the angle between the first movable structure and the ground and the angle between the second movable structure and the ground.

6 Claims, 6 Drawing Sheets

BOTTOM-FREE STATIONARY BIKE

CROSS-REFERENCE TO RELATED APPLICATIONS

The entire contents of Taiwan Patent Application No. 113102095, filed on Jan. 18, 2024, from which this application claims priority, are expressly incorporated herein by reference.

BACKGROUND OF THE INVENTION

1. Field of the Invention

The present invention relates to a bottom-free stationary bike.

2. Description of Related Art

Indoor exercise is great alternative to bad weather, and it provides a variety of benefits from being physically active on commercial fitness equipment, such as strengthening muscles, improving mood, burning calories, and enhancing physical fitness. Among the fitness equipment, stationary bikes are more helpful to improve cardiopulmonary function and strengthen core muscles.

Most of the commercial stationary bikes have a resistance adjustment function but cannot change the incline. Some bikes feature adjustable incline. For example, U.S. Pat. No. 10,561,877B2 (TW637770B) discloses an exercise machine that includes a frame, which includes a base portion, an upright portion, and a pivot joint. The upright portion couples to the base portion at a single pivot. The pivot joint connects the upright portion to the base portion at the single pivot. The pivot joint includes a drop-in axle and a drop-in receptacle. The drop-in axle connects to the upright portion. The drop-in receptacle connects to the base portion. The exercise machine further includes a tilt actuator that connects the base portion of the frame to the upright portion of the frame and determines an angle that the upright portion forms with respect to the base portion.

In addition, U.S. patent U.S. Pat. No. 9,278,249B2 discloses an exercise cycle including a base support, an upright support structure, a seat mounted on the upright support structure, a handlebar assembly mounted on the upright support structure, a pedal assembly connected to the upright support structure, and one or more vibration assemblies. The one or more vibration assemblies are controlled by a controller to adjust vibrations to cause at least one of the seat, the handlebar assembly, and the pedal assembly to simulate an outdoor trail. And the one or more vibration assemblies change intensity or frequency of the vibrations based on one of the tilted positions of the upright support structure. The exercise cycle further includes an extension mechanism connected between the base support and the upright support structure, wherein the extension mechanism selectively moves the upright support structure between the plurality of tilted positions.

Conventional stationary bikes all include a stable base structure that is pivotally connected to an upright structure above it. The angle between the upright structure and the base structure is changed through a tilt actuator or an extension mechanism between them, thereby changing the incline of the stationary bike.

SUMMARY OF THE INVENTION

This summary is provided to introduce a selection of concepts in a simplified form that are further described below in the detailed description. This summary, and the foregoing background, is not intended to identify key aspects or essential aspects of the claimed subject matter. Moreover, this summary is not intended for use as an aid in determining the scope of the claimed subject matter.

In one aspect, a stationary bike is provided with a first movable structure, a second movable structure, a frame, and a linear mechanism. The first movable structure comprises a first end in contact with a ground and a second end suspended above the ground, wherein the first movable structure is turnable with its first end as a fulcrum. The second movable structure comprises a first end in contact with the ground and a second end suspended above the ground, wherein the second movable structure is turnable with its first end as a fulcrum, and the second end of the first movable structure and the second end of the second movable structure are pivotally connected at a pivot. The frame is connected to the first movable structure. The linear mechanism is connected between the frame and the second movable structure, wherein a length of the linear mechanism is adjusted to change an angle between the first movable structure and the ground and an angle between the second movable structure and the ground.

In some embodiments, the frame comprises a handle support and a seat support.

In some embodiments, the linear mechanism is connected between the handle support and the second movable structure.

In some embodiments, the linear mechanism is connected between the seat support and the second movable structure.

In some embodiments, the stationary bike further comprises a resistance device, two cranks, and two pedals. The resistance device comprises an axis. The two cranks are arranged on a left side and a right side of the resistance device, and each of the two cranks includes a first end connected to the axis. The two pedals are respectively connected to a second end of one of the two cranks.

In some embodiments, the linear mechanism comprises a motor, a sleeve, and a screw. The sleeve comprises an internal thread to engage the screw, and the motor is used to drive the screw to rotate, so that the sleeve is moved along the screw toward or away from the motor, thereby changing the length of the linear mechanism.

In some embodiments, the linear mechanism comprises a linear actuator.

In some embodiments, both the first movable structure and the second movable structure are T-shaped.

In some embodiments, the first movable structure or the second movable structure further comprises a roller, and when the linear mechanism adjusts its length, the roller moves toward the front or rear of the stationary bike.

In some embodiments, when the linear mechanism adjusts its length to change the angle between the first movable structure and the ground and the angle between the second movable structure and the ground, both an angle between the handle support and the ground and an angle between the seat support and the ground change accordingly.

BRIEF DESCRIPTION OF THE DRAWINGS

Non-limiting and non-exhaustive embodiments of the disclosed technology, including the preferred embodiment, are described with reference to the following figures, wherein like reference numerals refer to like parts throughout the various views unless otherwise specified.

DETAILED DESCRIPTION OF THE PREFERRED EMBODIMENT

Embodiments are described more fully below with reference to the accompanying Figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
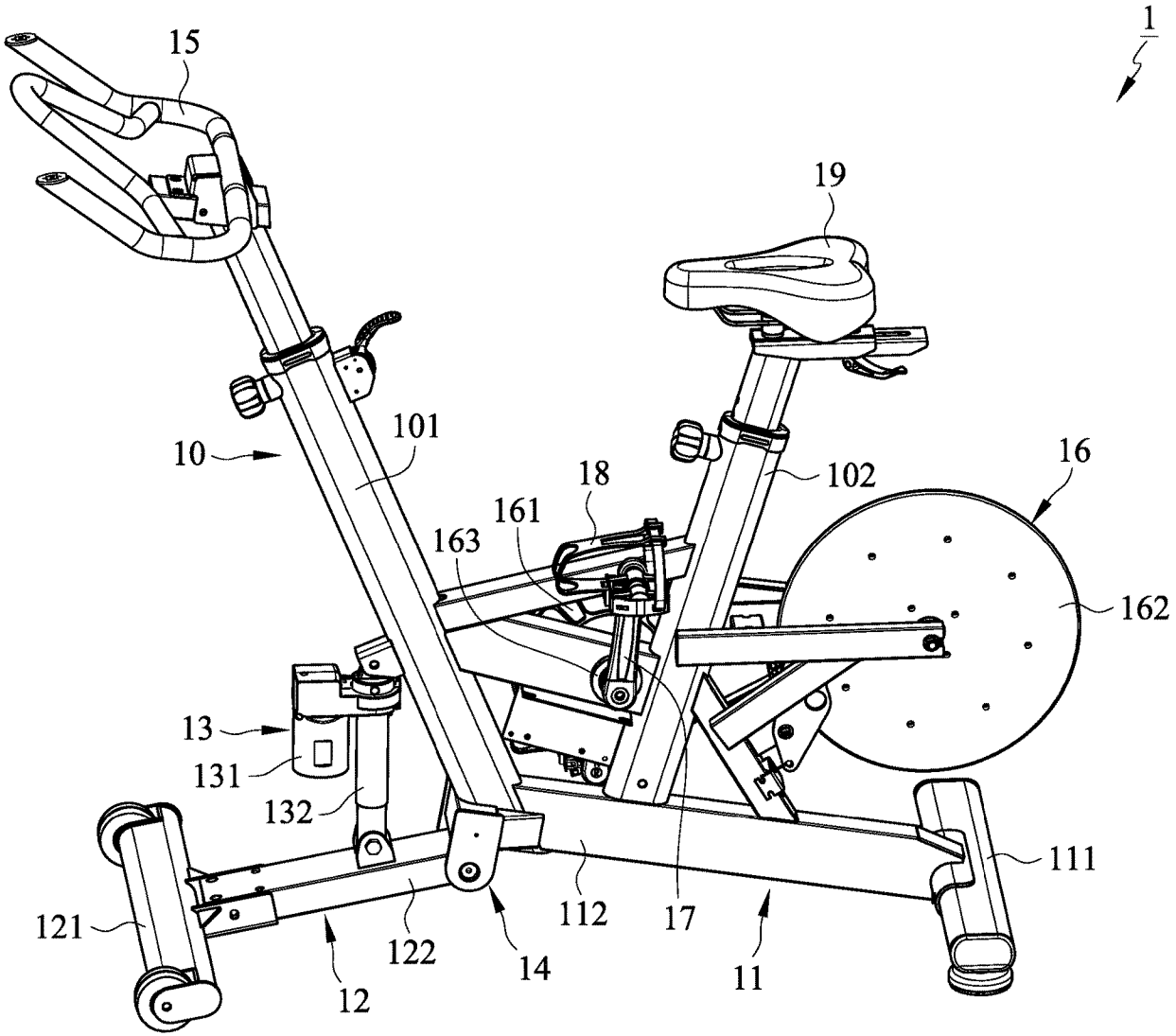
FIG. 1 is a perspective view showing a stationary bike in accordance with an embodiment of the present invention.
Figure 2:
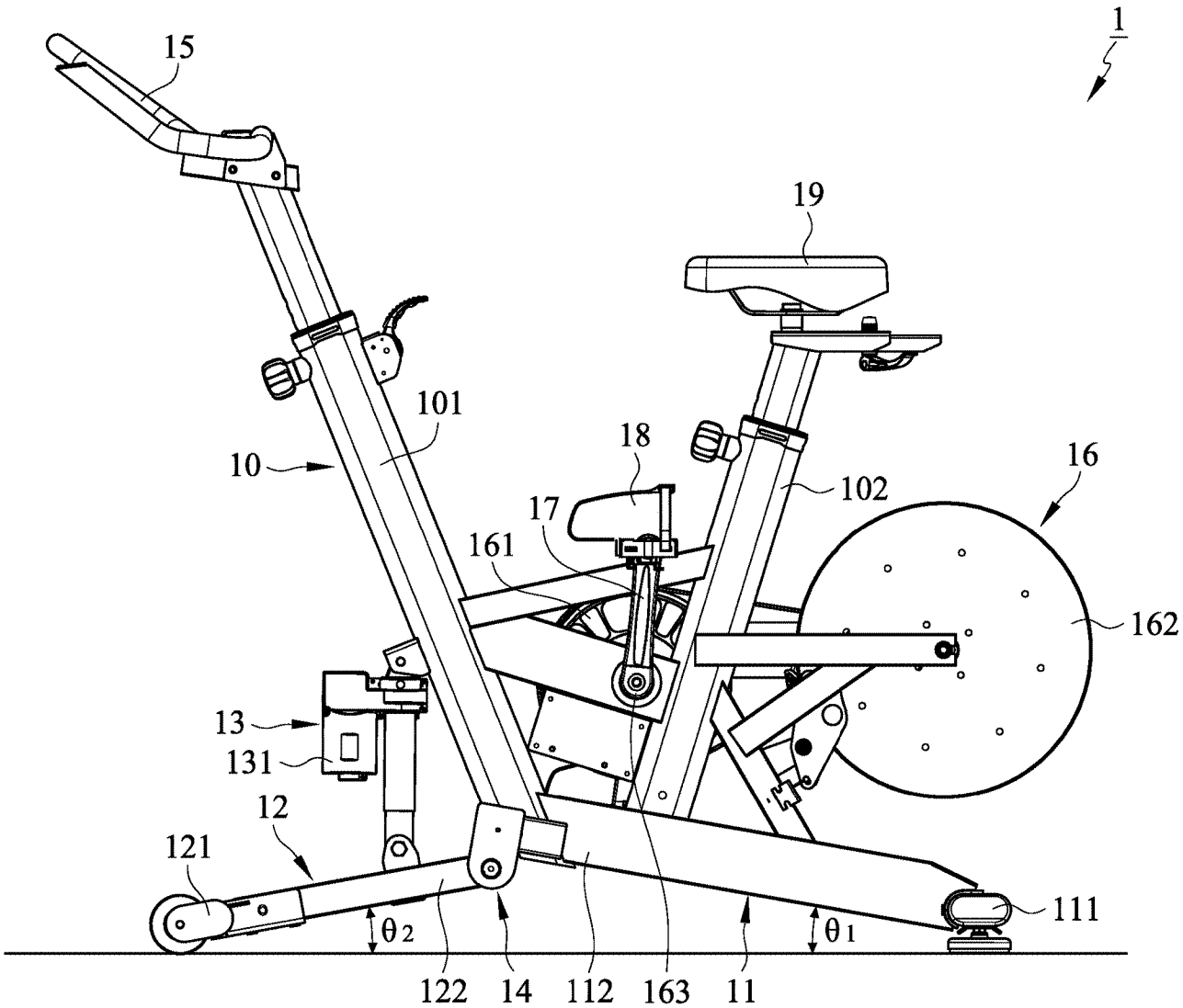
FIG. 2 is a side view shows that the stationary bike of FIG. 1 being operated in a first state.
Figure 3:
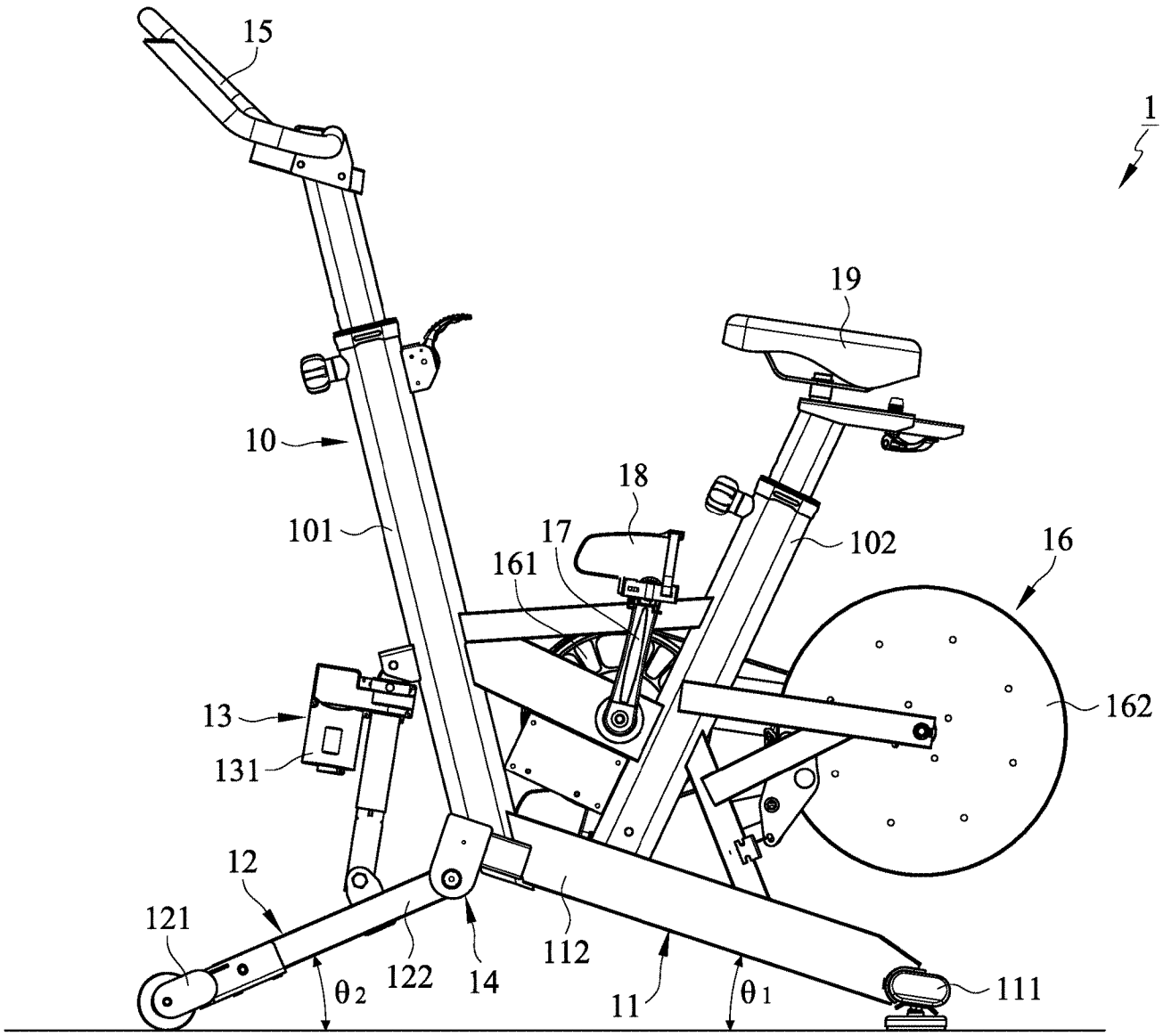
FIG. 3 is a side view shows that the stationary bike of FIG. 1 being operated in a second state.

FIG. 1 is a perspective view showing a stationary bike in accordance with an embodiment of the present invention. FIGS. 2 and 3 are side view shows that the stationary bike of FIG. 1 being respectively operated in a first state and a second state. Referring to FIGS. 1, 2, and 3, the stationary bike 1 generally includes a frame 10, a first movable structure 11, a second movable structure 12, and a linear mechanism 13.

Referring to FIGS. 1, 2, and 3, the first movable structure 11 includes a first end 111 and a second end 112, and the second movable structure 12 includes a first end 121 and a second end 122. The first movable structure 11 is turnable with its first end 111 as a fulcrum, resulting in a first included angle θ1 between the first movable structure 11 and the ground. The second movable structure 12 is turnable with its first end 121 as a fulcrum, resulting in a second included angle θ2 between the second movable structure 12 and the ground. The second end 112 of the first movable structure 11 and the second end 122 of the second movable structure 12 are pivotally connected at the pivot 14.

Referring to FIGS. 1, 2, and 3, "frame" refers to one or more support mechanisms above the first movable structure 11. In the exemplary embodiment, the frame 10 includes a handle support 101 and a seat support 102 on the first movable structure 11. In the exemplary embodiment, the handle support 101 and the seat support 102 are fixed with the first movable structure 11. Therefore, as the first included angle θ1 changes, the angles of the handle support 101 and the seat support 102 relative to the ground will change as well.

Referring to FIGS. 1, 2, and 3, the linear mechanism 13 is connected between the frame 10 and the second movable structure 12. The linear mechanism 13 can be connected to any of the one or more supporting mechanisms of the frame 10. In the exemplary embodiment, the linear mechanism 13 is connected between the handle support 101 of the frame 10 and the second movable structure 12. The linear mechanism 13 is capable of adjusting its length. When the linear mechanism 13 changes its length, the first movable structure 11 is turned with its first end 111 as a fulcrum, and the second movable structure 12 is turned with its first end 121 as a fulcrum, resulting in a change of the first included angle θ1 and a change of the second included angle θ2.

Referring to FIGS. 1, 2, and 3, in the exemplary embodiment, the linear mechanism 13 includes a motor 131, a sleeve 132, and a screw (hidden in the sleeve 132). The sleeve 132 includes an internal thread to engage the screw, and the motor 131 is used to drive the screw rotating. As the motor 131 drives the screw to rotate, the sleeve 132 moves along the screw in a direction toward or away from the motor 131, thereby changing the length of the linear mechanism 13. In other embodiments of the present invention, the linear mechanism 13 may be other linearly extendable devices, such as, but is not limited to, a linear actuator.

Referring to FIGS. 1, 2, and 3, in the exemplary embodiment, an upper end of the handle support 101 may connect a control panel (not shown) and a handle 15 for a user to hold. The control panel is connected to a control system (not shown). The user can input a desired incline through the control panel, and the control system outputs a control signal accordingly to control the linear mechanism 13, thereby changing the first included angle θ1 and the second included angle θ2, and hence changing an angle between the handle support 101 and ground and an angle between the seat support 102 and the ground. FIG. 2 shows that the linear mechanism is controlled at the shortest length, resulting in the minimum first included angle θ1 and the minimum second included angle θ2. FIG. 3 shows that the linear mechanism is controlled at the longest length, resulting in the maximum first included angle θ1 and the maximum second included angle θ2. Referring to FIGS. 2 and 3, the first end 121 of the second movable mechanism 12 may include a roller. When the second included angle θ2 increases, the roller will move toward the rear of the stationary bike 1. When the second included angle θ2 decreases, the roller will move toward the front of the stationary bike 1.

Referring to FIGS. 1, 2, and 3, a feature of the stationary bike 1 is that even if the linear mechanism is controlled at the shortest length, the first included angle θ1 and the second included angle θ2 are not zero. That is, only the first end 111 of the first movable structure 11 is in contact with the ground, and only the first end 121 of the second movable structure 12 is in contact with the ground. In other words, the stationary bike of the present invention does not include a "base" in contact with the ground, but the first movable structure 11 and the second movable structure 12 replace the traditional "base". In the exemplary embodiment, both the first movable structure 11 and the second movable structure 12 are, but are not limited to, T-shaped structure.

Referring to FIGS. 1, 2, and 3, in the exemplary embodiment, the stationary bike 1 include a resistance device 16. As a non-limiting example, the resistance device 16 may include a pulley 161 and a flywheel 162. The pulley 161 includes an axis 163 and connects to the flywheel 162 through a connecting member, e.g., a belt. In addition, the stationary bike 1 may further include two cranks 17 and two pedals 18. The two cranks 17 are respectively located on the left and right sides of the pulley 161. Each crank 17 includes a first end connected to the axis 163 and a second end connected to a corresponding pedal 18. The top of the seat support 102 connects to a seat 19. The user sits on the seat 19 with his or her feet placed on the pedals 18.

Figure 4:
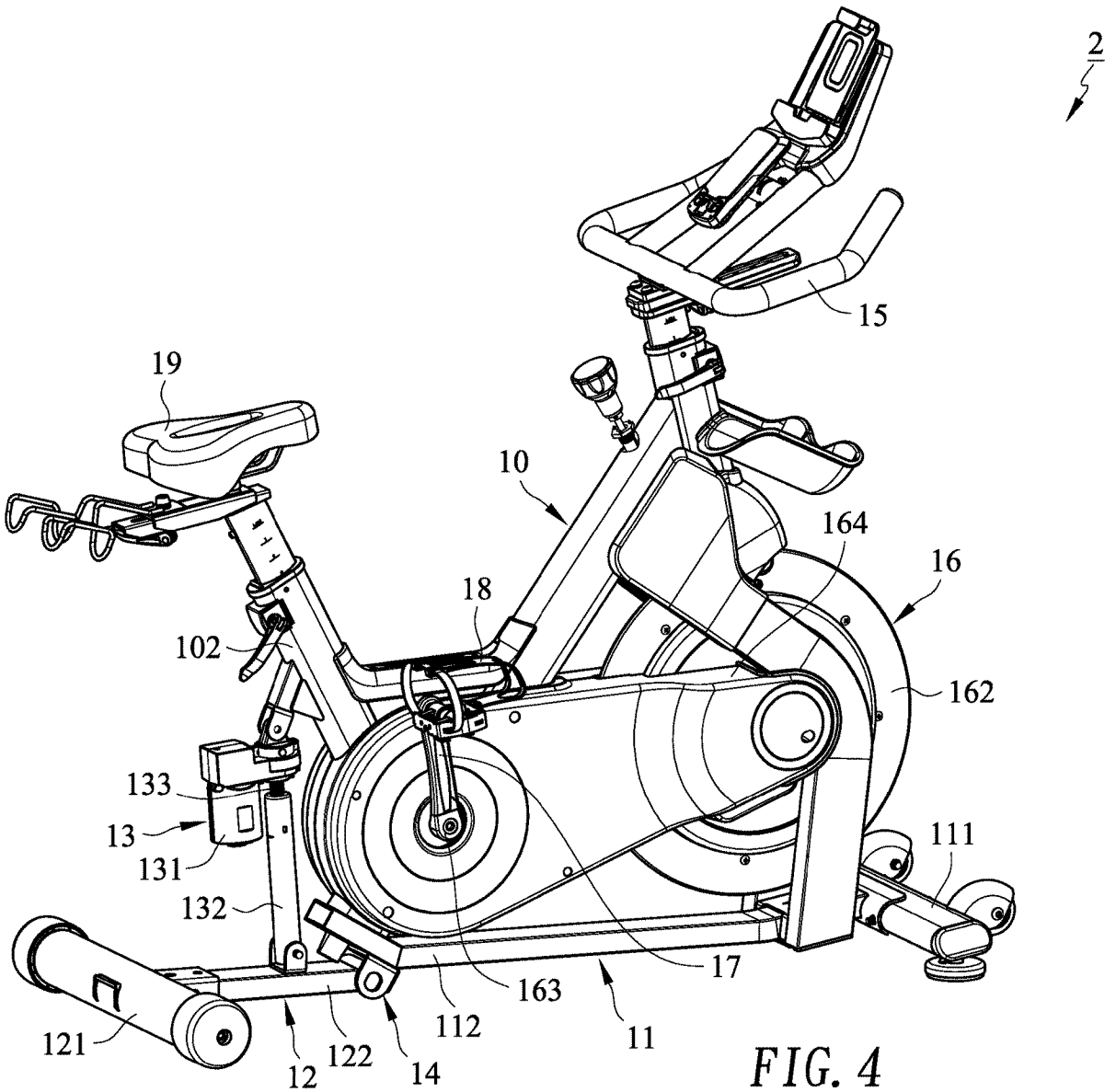
FIG. 4 is a perspective view showing a stationary bike in accordance with another embodiment of the present invention.
Figure 5:
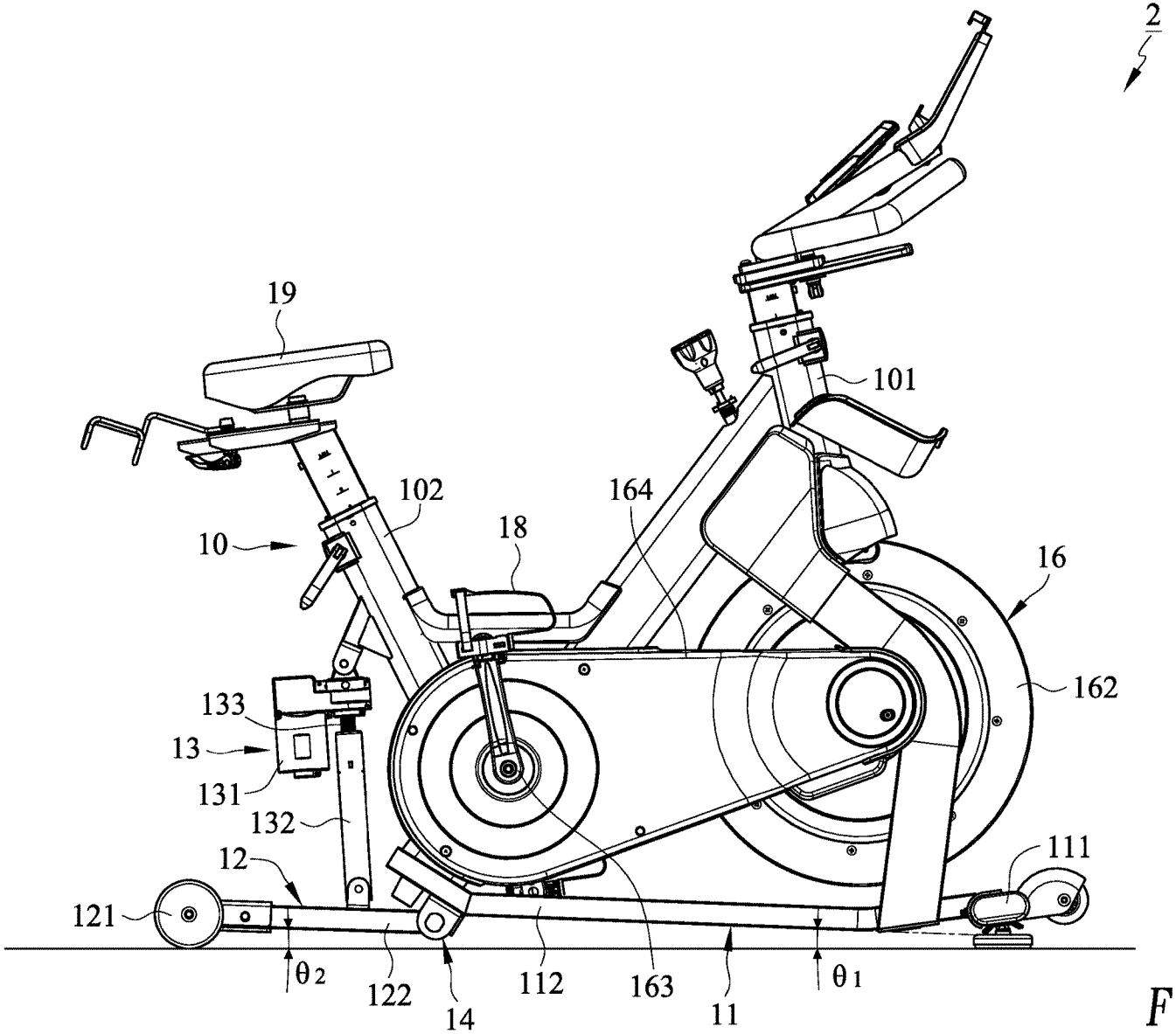
FIG. 5 is a side view shows that the stationary bike of FIG. 4 being operated in a first state.
Figure 6:
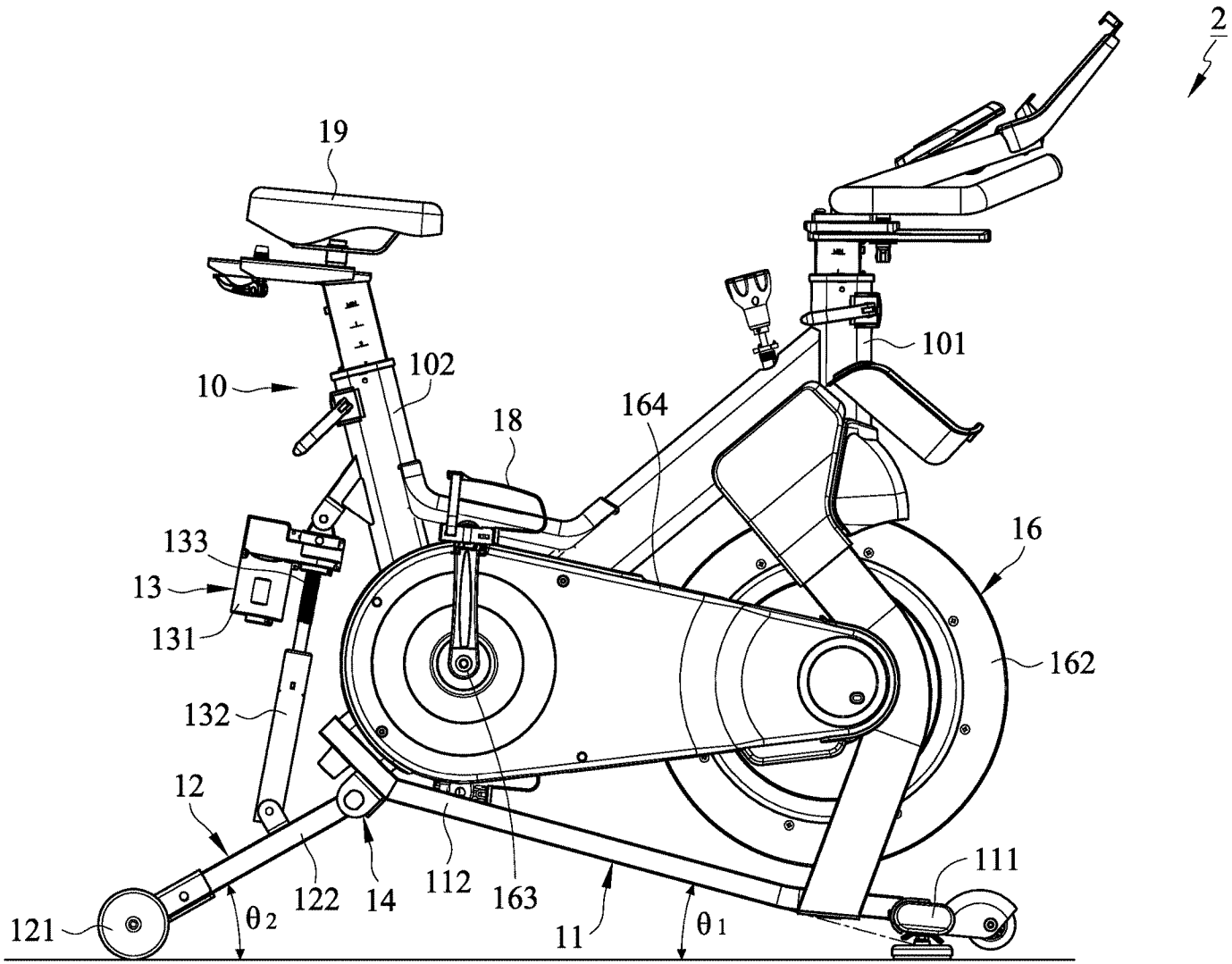
FIG. 6 is a side view shows that the stationary bike of FIG. 5 being operated in a second state.

FIG. 4 is a perspective view showing a stationary bike 2 according to another embodiment of the present invention. FIGS. 5 and 6 are side view shows that the stationary bike of FIG. 1 being respectively operated in a first state and a second state. Referring to FIGS. 4, 5, and 6, the stationary bike 2 generally includes a frame 10, a first movable structure 11, a second movable structure 12, and a linear mechanism 13.

Referring to FIGS. 4, 5, and 6, the first movable structure 11 includes a first end 111 and a second end 112, and the second movable structure 12 includes a first end 121 and a second end 122. The first movable structure 11 is turnable with its first end 111 as a fulcrum, resulting in a first included angle θ1 between the first movable structure 11 and the ground. The second movable structure 12 is turnable with its first end 121 as a fulcrum, resulting in a second included angle θ2 between the second movable structure 12 and the ground. The second end 112 of the first movable structure 11 and the second end 122 of the second movable structure 12 are pivotally connected at the pivot 14.

Referring to FIGS. 4, 5, and 6, in the exemplary embodiment, the frame 10 includes a handle support 101 and a seat support 102 on the first movable structure 11. In the exemplary embodiment, the handle support 101 and the seat support 102 are fixed with the first movable structure 11. Therefore, as the first included angle θ1 changes, the angles of the handle support 101 and the seat support 102 relative to the ground will change as well.

Referring to FIGS. 4, 5, and 6, the linear mechanism 13 is connected between the frame 10 and the second movable structure 12. The linear mechanism 13 can be connected to any of the one or more supporting mechanisms of the frame 10. In the exemplary embodiment, the linear mechanism 13 is connected between the seat support 102 of the frame 10 and the second movable structure 12. The linear mechanism 13 is capable of adjusting its length. When the linear mechanism 13 changes its length, the first movable structure 11 is turned with its first end 111 as a fulcrum, and the second movable structure 12 is turned with its first end 121 as a fulcrum, resulting in a change of the first included angle θ1 and a change of the second included angle θ2. And hence, an angle between the handle support 101 and ground and an angle between the seat support 102 and the ground change as well.

Referring to FIGS. 4, 5, and 6, in the exemplary embodiment, the linear mechanism 13 includes a motor 131, a sleeve 132, and a screw 133. The sleeve 132 includes an internal thread to engage the screw 133, and the motor 131 is used to drive the screw 133 rotating. As the motor 131 drives the screw to rotate, the sleeve 132 moves along the screw 133 in a direction toward or away from the motor 131, thereby changing the length of the linear mechanism 13. In other embodiments of the present invention, the linear mechanism 13 may be other linearly extendable devices, such as, but is not limited to, a linear actuator.

Referring to FIGS. 4, 5, and 6, in the exemplary embodiment, an upper end of the handle support 101 connects a control panel (not shown) and a handle 15 for a user to hold. The control panel is connected to a control system (not shown). The user can input a desired incline through the control panel, and the control system outputs a control signal accordingly to control the linear mechanism 13, thereby changing the first included angle θ1 and the second included angle θ2, and hence changing the angle between the handle support 101 and ground and an angle between the seat support 102 and the ground. FIG. 5 shows that the linear mechanism is controlled at the shortest length, resulting in the minimum first included angle θ1 and the minimum second included angle θ2. FIG. 6 shows that the linear mechanism is controlled at the longest length, resulting in the maximum first included angle θ1 and the maximum second included angle θ2. Referring to FIGS. 5 and 6, the first end 111 of the first movable mechanism 12 may include a roller in contact with the ground. When the first included angle θ1 increases, the roller will move toward the rear of the stationary bike 1. When the second included angle θ1 decreases, the roller will move toward the front of the stationary bike 1.

Referring to FIGS. 4, 5, and 6, the first end 111 of the first movable structure 11 and the first end 121 of the second movable structure 12 are elevated through pads and/or structures. Accordingly, even if the length of the linear mechanism is controlled to the shortest so that the first included angle θ1 and the second included angle θ2 are close to zero, the first movable structure 11 has only its first end 111 in contact with the ground, and the second movable structure 12 has only its first end 121 in contact with the ground.

Referring to FIGS. 4, 5, and 6, in the exemplary embodiment, the stationary bike 2 includes a resistance device 16. As a non-limiting example, the resistance device 16 may include a pulley (hidden in a housing 164) and a flywheel 162. The pulley includes an axis 163 and connects to the flywheel 162 through a connecting member, e.g., a belt. In addition, the stationary bike 2 further includes two cranks 17 and two pedals 18. The two cranks 17 are respectively located on the left and right sides of the pulley (hidden in the housing 164). Each crank 17 includes a first end connected to the axis 163 and a second end connected to a corresponding pedal 18. The top of the seat support 102 connects to a seat 19. The user sits on the seat 19 with his or her feet placed on the pedals 18.

As shown in the above embodiments, the traditional "base" is replaced by the first movable structure 11 and the second movable structure 12. This design allows the stationary bike 1 and the stationary bike 2 to have a broader adjustable incline range.

Although the above two embodiments both show a stationary bike with an adjustable incline. It is understood that the principles described in this specification can be applied to any suitable exercise equipment, such as, but not limited to, elliptical trainers, steppers, rowing machines, etc.

From the foregoing, it will be appreciated that specific embodiments of the invention have been described herein for purposes of illustration, but that various modifications may be made without deviating from the scope of the invention. Accordingly, the invention is not limited except as by the appended claims.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended.

What is claimed is:

1. A stationary bike, comprising:

a first movable structure comprising a first end in contact with a ground and a second end suspended above the ground, wherein the first movable structure is turnable with its first end as a fulcrum;

a second movable structure comprising a first end in contact with the ground and a second end suspended above the ground, wherein the second movable structure is turnable with its first end as a fulcrum, and the second end of the first movable structure and the second end of the second movable structure are pivotally connected at a pivot;

a frame being connected to the first movable structure and comprising a handle support and a seat support;

a resistance device comprising an axis;

two cranks being arranged on a left side and a right side of the resistance device, and each of the two cranks comprises a first end connected to the axis;

two pedals being respectively connected to a second end of one of the two cranks; and a linear mechanism being connected between the handle support and the second movable structure or being connected between the seat support and the second movable structure, wherein a length of the linear mechanism is adjusted to change an angle between the first movable structure and the ground and an angle between the second movable structure and the ground.

2. The stationary bike according to claim 1, wherein the linear mechanism comprises a motor, a sleeve, and a screw, the sleeve comprises an internal thread to engage the screw, and the motor is used to drive the screw to rotate, so that the sleeve is moved along the screw toward or away from the motor, thereby changing the length of the linear mechanism.

3. The stationary bike according to claim 1, wherein the linear mechanism comprises a linear actuator.

4. The stationary bike according to claim 1, wherein both the first movable structure and the second movable structure are T-shaped.

5. The stationary bike according to claim 1, wherein the first movable structure or the second movable structure further comprises a roller, and when the linear mechanism adjusts its length, the roller moves toward the front or rear of the stationary bike.

6. The stationary bike according to claim 1, wherein when the linear mechanism adjusts its length to change the angle between the first movable structure and the ground and the angle between the second movable structure and the ground, both an angle between the handle support and the ground and an angle between the seat support and the ground change accordingly.

* * * * *